US010886668B1

(12) United States Patent
Morello et al.

(10) Patent No.: US 10,886,668 B1
(45) Date of Patent: Jan. 5, 2021

(54) COAXIAL CABLE CONNECTOR ASSEMBLY

(71) Applicant: Aptiv Technologies Limited, St. Michael (BB)

(72) Inventors: John R. Morello, Warren, OH (US); James M. Rainey, Warren, OH (US)

(73) Assignee: APTIV TECHNOLOGIES LIMITED

( * ) Notice: Subject to any disclaimer, the term of this patent is extended or adjusted under 35 U.S.C. 154(b) by 0 days.

(21) Appl. No.: 16/594,820

(22) Filed: Oct. 7, 2019

(51) Int. Cl.
*H01R 13/6592* (2011.01)
*H01R 13/6582* (2011.01)

(52) U.S. Cl.
CPC ..... *H01R 13/6592* (2013.01); *H01R 13/6582* (2013.01)

(58) Field of Classification Search
CPC ..... H01R 13/6592; H01R 13/6582; H01R 9/0515; H01R 13/5219; H01R 12/724; H01R 24/60; H01R 13/6315; H01R 13/504; H01R 13/516; H01R 12/712
USPC ..... 439/578
See application file for complete search history.

(56) References Cited

U.S. PATENT DOCUMENTS 6,379,183 B1 * 4/2002 Ayres ..... H01R 9/0515 439/578
7,195,505 B1 * 3/2007 Becker ..... H01R 13/5219 439/271
7,794,274 B2 9/2010 Phillips, Jr.
8,597,036 B2 * 12/2013 Fogg ..... H01R 12/724 439/101
8,969,725 B2 3/2015 Mayer
9,762,001 B2 9/2017 Morello et al.
10,236,626 B2 3/2019 Panitz
2005/0048846 A1 * 3/2005 Suzuki ..... H01R 24/60 439/660
2011/0065315 A1 * 3/2011 Xuan ..... H01R 12/712 439/540.1
2011/0201228 A1 * 8/2011 Schumacher ..... H01R 13/516 439/374
2015/0004845 A1 * 1/2015 Barrefelt ..... H01R 13/504 439/626
2015/0118902 A1 * 4/2015 Data ..... H01R 13/6315 439/587
2015/0200493 A1 * 7/2015 Gao ..... H01R 13/6582 439/607.28

FOREIGN PATENT DOCUMENTS

EP 584937 B1 3/1998

* cited by examiner

*Primary Examiner* — Jean F Duverne
(74) *Attorney, Agent, or Firm* — Rob Myers; Billion & Armitage

(57) ABSTRACT

An electrical connector assembly includes a dielectric connector housing having a cavity extending longitudinally therethrough and a shield terminal disposed within the cavity. The shield terminal has an attachment portion configured to receive a shield conductor of a coaxial cable and a connection portion configured to receive a cylindrical mating shield terminal. The connection portion defines a first cylindrical sector and a second cylindrical sector arranged opposite one another. The connection portion and the cavity cooperate to put the first and second cylindrical sectors in intimate contact with, and apply a compressive force to, the mating shield terminal when the mating shield terminal is inserted within the connection portion.

18 Claims, 6 Drawing Sheets

COAXIAL CABLE CONNECTOR ASSEMBLY

TECHNICAL FIELD OF THE INVENTION

The invention generally relates to a coaxial cable connector assembly.

BACKGROUND OF THE INVENTION

Coaxial cable connector assemblies have been used for numerous automotive applications, such as navigation systems, infotainment systems, air bag systems, and other data transmission systems. Coaxial cables typically consist of an outer shield conductor, an inner center conductor, a dielectric, and an insulation jacket. The outer conductor and the inner conductor of the coaxial cable often electrically interface with a mating coaxial cable through a coaxial connector assembly.

Radio Frequency (RF) connectors most often referred to simply as RF connectors are often used to connect coaxial cables while providing a certain degree of shielding. The use of RF connectors for coaxial cable has greatly increased in automotive applications as devices requiring high speed data communication continue to proliferate.

The use of RF connectors for automotive usage has become so common that standards for signal loss and contact resistance have been devised. Some RF connectors that meet these specifications use high cost cold drawn tubular shield terminals. Lower cost stamped shield terminals are also used, however these shield terminals generally provide less effective shielding due to the limited contact points between shield terminals provided by cantilevered contact springs, contact bumps, or separate contact spring inserts.

RF connectors need to be properly seated to provide adequate shielding i.e. improper seating between shield terminals can cause significant RF leakage. Thus, RF connectors use strict manufacturing tolerances to assure proper seating which drives costs up of each RF connector. A modern automobile may have over forty of such RF connectors.

Therefore, a low cost RF connector having stamped terminal connectors which meets all performance specifications and has improved shielding remains desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

According to one embodiment of the invention, an electrical connector assembly is provided. The electrical connector assembly includes a dielectric connector housing having a cavity extending longitudinally therethrough and a shield terminal disposed within the cavity. The shield terminal has an attachment portion configured to receive a shield conductor of a coaxial cable and a connection portion configured to receive a cylindrical mating shield terminal. The connection portion and the cavity of the connector housing cooperate to apply a compressive force on the mating shield terminal when the mating shield terminal is inserted within the connection portion.

In an example embodiment having one or more features of the electrical connector assembly of the previous paragraph, at least 30 percent of the connection portion inner wall is in intimate contact with the mating shield terminal outer wall when the mating shield terminal is inserted within the connection portion.

In an example embodiment having one or more features of the electrical connector assembly of the previous paragraph, at least 60 percent of the connection portion inner wall is in intimate contact with the mating shield terminal outer wall when the mating shield terminal is inserted within the connection portion.

In an example embodiment having one or more features of the electrical connector assembly of the previous paragraph, the shield terminal is configured such that an effective diameter of the connection portion inner wall increases when the mating shield terminal is inserted within the connection portion.

In an example embodiment having one or more features of the electrical connector assembly of the previous paragraph, intersections between the connection portion and a cavity inner wall define two separate longitudinal contact zones. Additionally, the cavity defines a gap between a remainder of the connection portion and the cavity inner wall.

According to another embodiment of the invention, an electrical connector assembly is provided. The electrical connector assembly includes a dielectric connector housing having a cavity extending longitudinally therethrough and a shield terminal disposed within the cavity. The shield terminal has an attachment portion configured to receive a shield conductor of a coaxial cable and a connection portion configured to receive a cylindrical mating shield terminal. The connection portion defines a first cylindrical sector and a second cylindrical sector arranged opposite one another, each having a first radius. The first and second cylindrical sectors are in intimate contact with a mating shield terminal outer wall when the mating shield terminal is inserted within the connection portion.

In an example embodiment having one or more features of the first cylindrical and second cylindrical sectors each define an angle of at least 54 degrees.

In an example embodiment having one or more features of the electrical connector assembly of the previous paragraph, the angle defined by the first cylindrical sector and the second cylindrical sector is at least 108 degrees.

In an example embodiment having one or more features of the electrical connector assembly of the previous paragraph, the first radius is substantially equal to a mating shield terminal radius.

In an example embodiment having one or more features of the electrical connector assembly of the previous paragraph, the connection portion defines a third cylindrical sector having a second radius that is greater than the first radius and a fourth cylindrical sector having the second radius. The connection portion also defines a first transition section located between the first cylindrical sector and the third cylindrical sector and further defines a second transition section located between the second cylindrical sector and the fourth cylindrical sector.

In an example embodiment having one or more features of the electrical connector assembly of the previous paragraph, the first transition section is in contact with a cavity inner wall, thereby defining a longitudinal contact zone and the second transition section is also is in contact with the cavity inner wall, thereby defining another longitudinal contact zone with the cavity inner wall.

In an example embodiment having one or more features of the electrical connector assembly of the previous paragraph, cavity defines a gap between a remainder of the connection portion and the cavity inner wall.

In an example embodiment having one or more features of the electrical connector assembly of the previous paragraph, the connection portion defines a longitudinal slot intermediate the third cylindrical sector and the fourth cylindrical sector.

In an example embodiment having one or more features of the electrical connector assembly of the previous paragraph, the connection portion defines a fifth cylindrical sector having a third radius that is greater than the first radius. The fifth cylindrical sector is disposed intermediate the first cylindrical sector and the second cylindrical sector. A third transition section is defined between the first cylindrical sector and the fifth cylindrical sector. A fourth transition section is defined between the second cylindrical sector and the fifth cylindrical sector.

In an example embodiment having one or more features of the electrical connector assembly of the previous paragraph, the cavity defines a first longitudinal groove in which the third and fourth cylindrical sectors are received. The cavity additionally defines a second longitudinal groove in which the fifth cylindrical sector is received.

In an example embodiment having one or more features of the electrical connector assembly of the previous paragraph, a first longitudinal groove width is greater than a second longitudinal groove width.

In an example embodiment having one or more features of the electrical connector assembly of the previous paragraph, leading edges of the first and second cylindrical sectors are chamfered.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
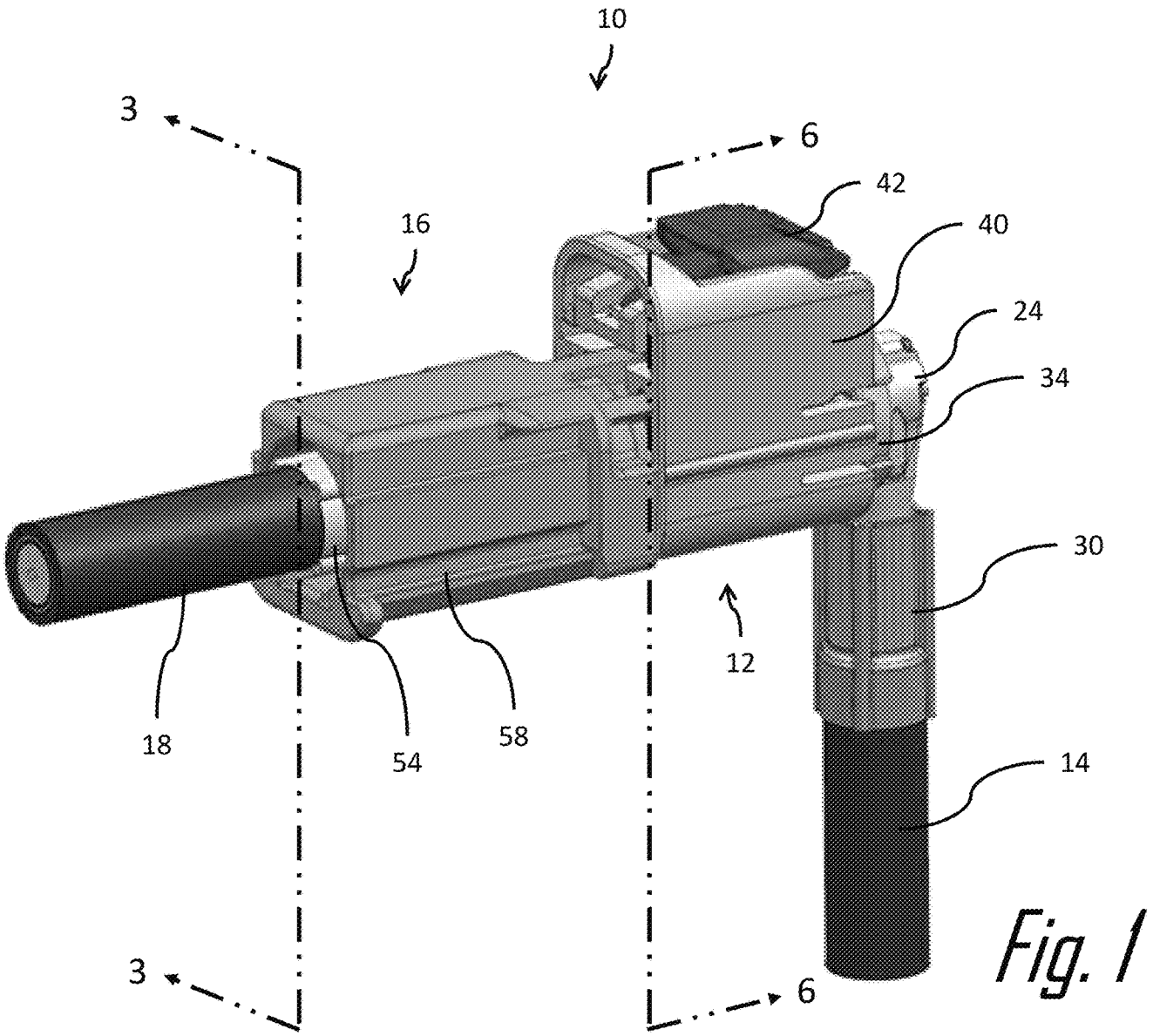
FIG. 1 is a perspective view of an electrical connector assembly according to one embodiment of the invention.
Figure 2:
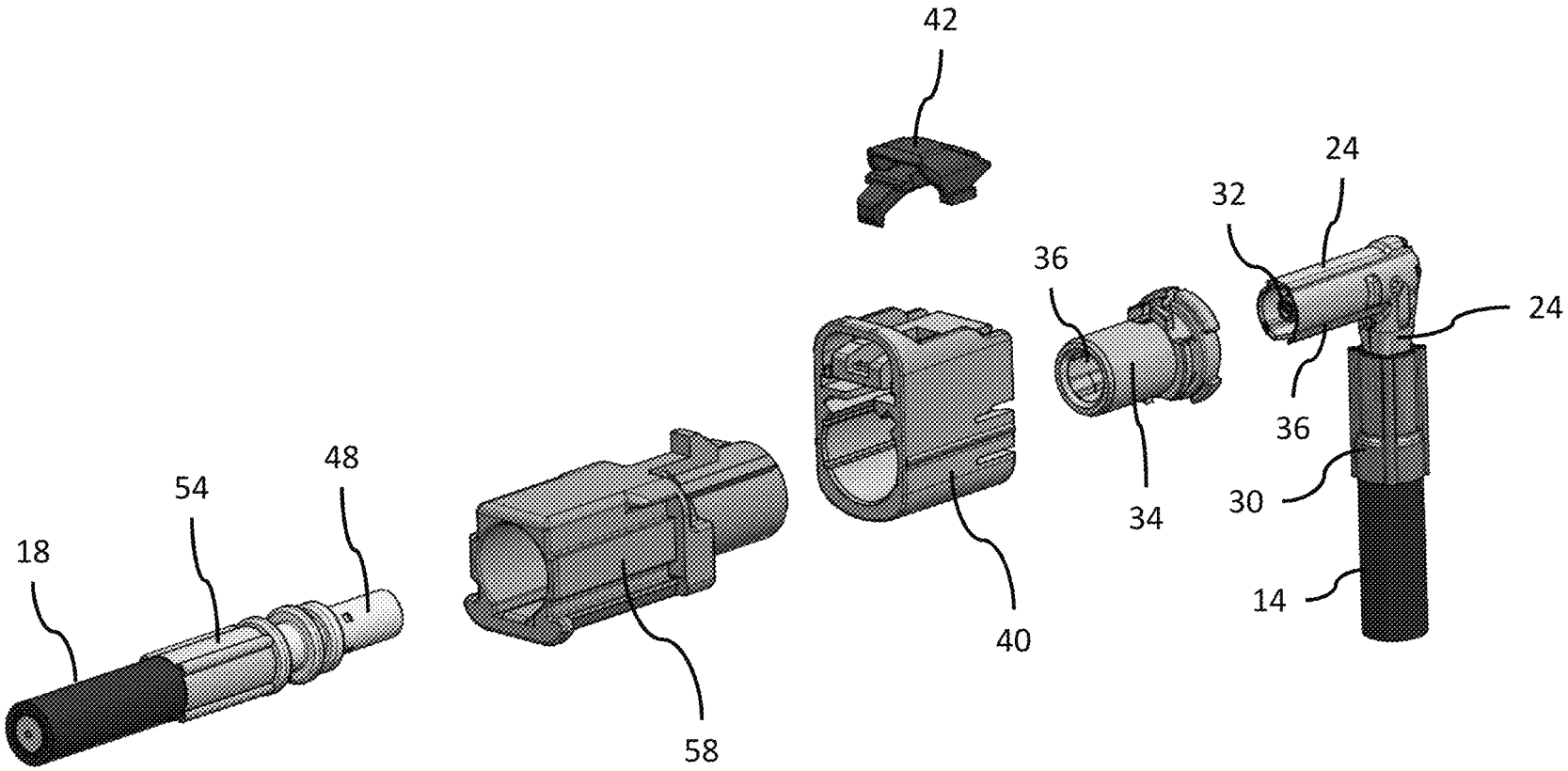
FIG. 2 is an exploded view of the electrical connector assembly of FIG. 1 according to one embodiment of the invention.
Figure 3:
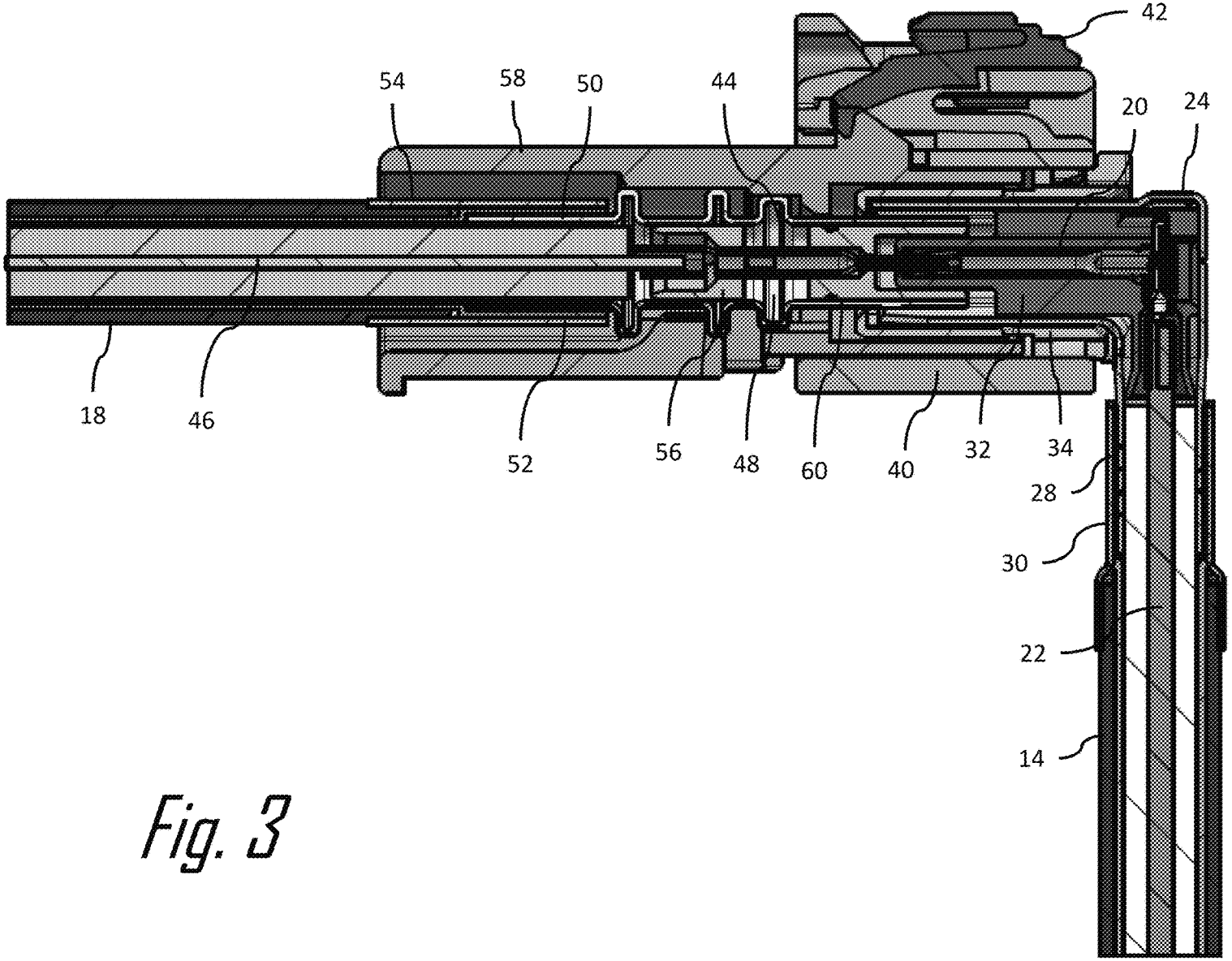
FIG. 3 is cross section side view of the electrical connector assembly of FIG. 1 according to one embodiment of the invention.

FIGS. 1-3 illustrate a non-limiting example of an electrical connector assembly according to one or more embodiments of the invention. The example electrical connector assembly, hereinafter referred to as the assembly 10, shown in FIG. 1 is used to interconnect coaxial cables and conforms to a FAKRA standard. FAKRA is the Automotive Standards Committee in the German Institute for Standardization (in German "Deutsches Institut für Normung", best known by the acronym DIN), representing international standardization interests in the automotive field. The FAKRA standard provides a system, based on keying and color coding, for proper connector attachment. Like socket keys can only be connected to like plug keyways in FAKRA connectors. Secure positioning and locking of connector housings is facilitated by way of a FAKRA defined catch on the socket housing and a cooperating latch on the plug housing. The FAKRA standard is contained in the USCAR-18 standard published by the United States Council for Automotive Research (USCAR).

As best shown in FIGS. 2 and 3, the assembly 10 includes a female connector assembly 12 terminating a first coaxial cable 14 and a male connector assembly 16 terminating a second coaxial cable 18. The female connector assembly 12 includes a female socket terminal 20 connected to the center conductor 22 of the first coaxial cable 14 and a female shield terminal 24 that longitudinally surrounds the female socket terminal 20. An attachment portion 26 of the female shield terminal 24 is connected to the shield conductor 28 of the first coaxial cable 14 and secured to the first coaxial cable 14 by a first ferrule 30. The female connector assembly 12 also includes a dielectric insulator 32 between the female socket terminal 20 and the female shield terminal 24. The female connector assembly 12 further includes an inner connector housing 34 that defines a cavity 36 in which a connection portion 38 of the female shield terminal 24 is received. The female connector assembly 12 additionally includes an outer connector housing 40 in which the inner connector housing 34 is disposed and a moveable connector position assurance device 42 that is configured to maintain a connection between the female connector assembly 12 and the male connector assembly 16 once they are fully mated.

The male connector assembly 16 includes a male pin terminal 44 connected to the center conductor 46 of the second coaxial cable 18 and a male shield terminal 48 that longitudinally surrounds the male pin terminal 44. An attachment portion 50 of the male shield terminal 48 is connected to the shield conductor 52 of the second coaxial cable 18 and secured to the second coaxial cable 18 by a second ferrule 54. The male connector assembly 16 also includes a dielectric insulator 56 between the male pin terminal 44 and the male shield terminal 48. The male connector assembly 16 additionally includes a connector housing 58 in which the male shield terminal 48 and male pin terminal 44 are disposed. The connection portion 60 of the male shield terminal 48 is received within the female shield terminal 24 and the male pin terminal 44 is received within the female socket terminal 20 when the connector housing 58 of the male connector assembly 16 is mated with the outer connector housing 40 of the female connector assembly 12, thereby interconnecting the first and second coaxial cables 14, 18.

In alternative embodiments, the male and/or female contactor may terminate other circuit elements, such as conductive traces on a printed circuit board.

Figure 4:
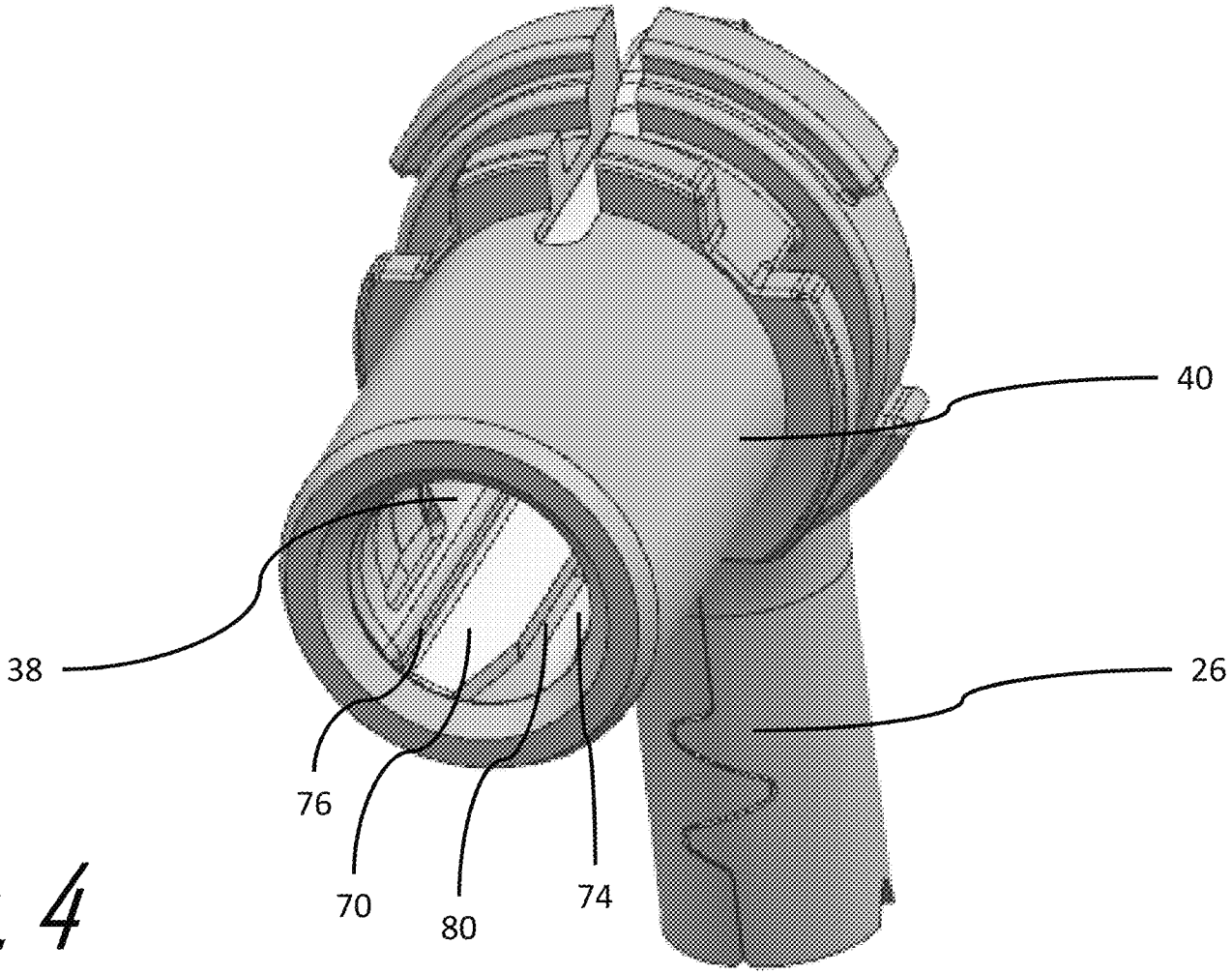
FIG. 4 is an front perspective view of a female connector assembly of the electrical connector assembly of FIG. 1 according to one embodiment of the invention.

Focusing now on the female connector assembly 12, the inner connector housing 34, best shown in FIG. 4, is formed of a dielectric material, such as a glass filled polymer. The cavity 36 of the inner connector housing 34 extends longitudinally through the inner connector housing 34. The female shield terminal 24 is formed from a sheet of conductive material, such as a plated copper-based material, e.g. by stampings and bending processes.

Figure 5:
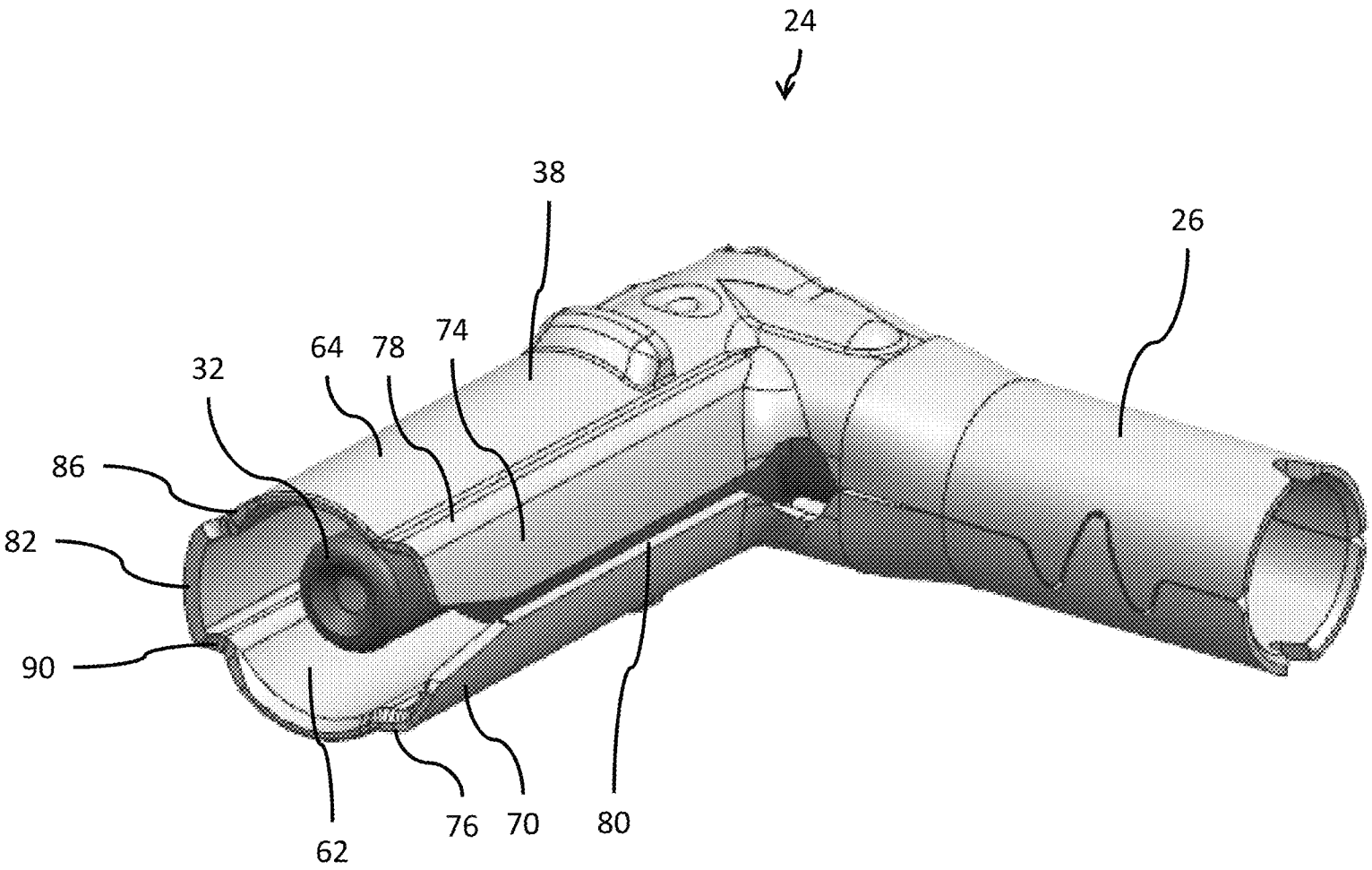
FIG. 5 is a perspective view an outer shield terminal of the female connector assembly of FIG. 4 according to one embodiment of the invention.
Figure 6:
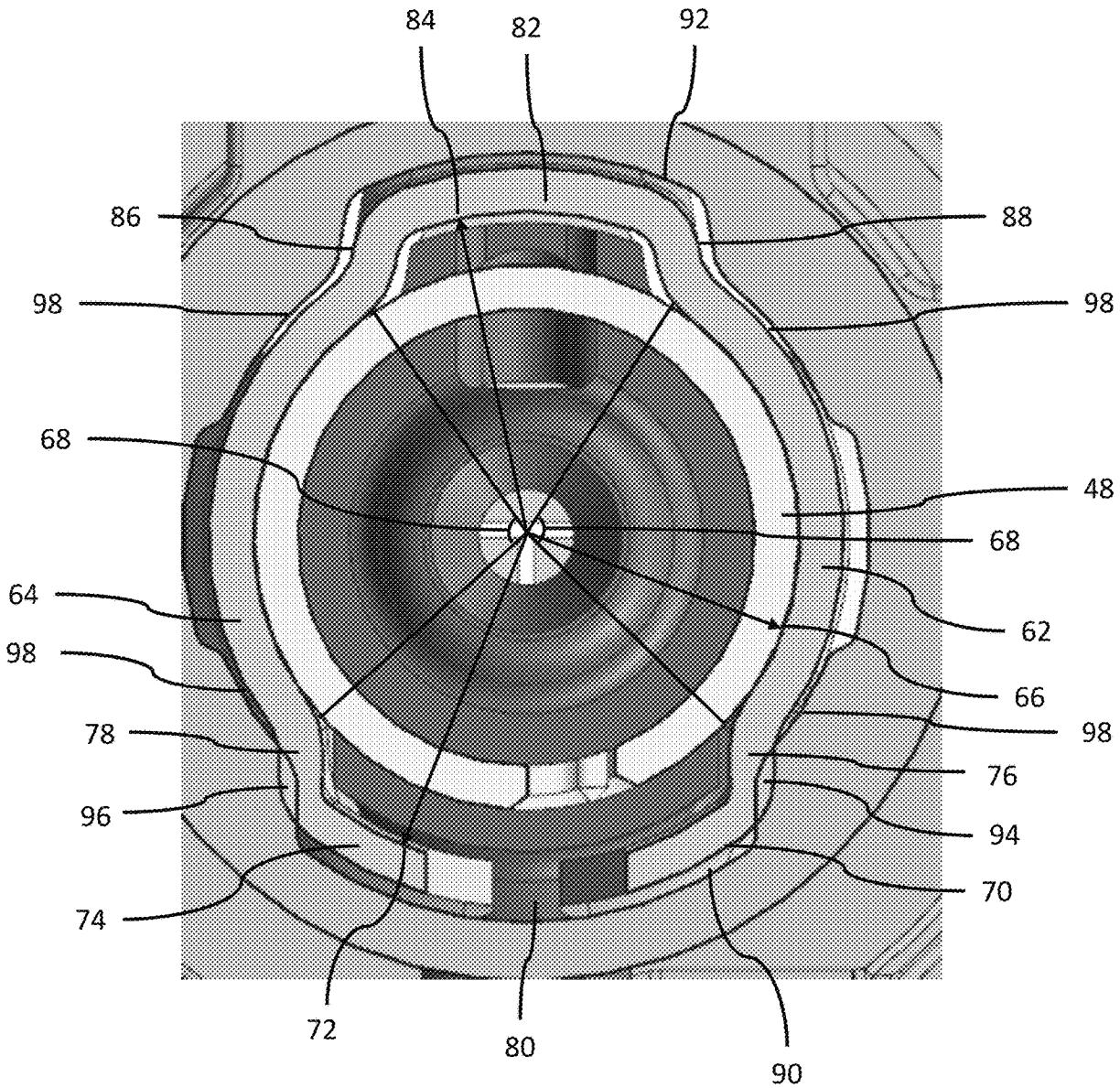
FIG. 6 is a cross section end view of the electrical connector assembly of FIG. 1 according to one embodiment of the invention.

As shown in FIG. 5, the connection portion 38 of the female shield terminal 24 has a generally tubular shape. The connection portion 38 is formed to have a first cylindrical sector 62 and a second cylindrical sector 64 that is arranged opposite the first cylindrical sector 62. Each of the first and second cylindrical sectors 62, 64 have a first radius 66 that is substantially equal to an outer radius of the connection portion 60 of the male shield terminal 48 as shown in FIG. 6. As used herein, substantially equal means within ±2% of absolutely equal. The first and second cylindrical sectors 62, 64 each define a sector angle 68 having a measurement of 54 to 108 degrees or more. The connection portion 38 also includes a third cylindrical sector 70 having a second radius 72 that is greater than the first radius 66 and a fourth cylindrical sector 74 having the same second radius 72. A first transition section 76 is located between the first cylindrical sector 62 and the third cylindrical sector 70 and a second transition section 78 is located between the second cylindrical sector 64 and the fourth cylindrical sector 74. The connection portion 38 defines a longitudinal slot 80 intermediate the third cylindrical sector 70 and the fourth cylindrical sector 74. The connection portion 38 also defines a fifth cylindrical sector 82 having a third radius 84 that is greater than the first radius 66. The fifth cylindrical sector 82 is disposed intermediate the first cylindrical sector 62 and the second cylindrical sector 64 and generally opposite the longitudinal slot 80. A third transition section 86 is defined between the first cylindrical sector 62 and the fifth cylindrical sector 82 and a fourth transition section 88 is defined between the second cylindrical sector 64 and the fifth cylindrical sector 82.

As illustrated in FIG. 6, the cavity 36 of the inner connector housing 34 is generally cylindrical. However, the cavity 36 defines a first longitudinal groove 90 in which the third and fourth cylindrical sectors 70, 74 are received and a second longitudinal groove 92 in which the fifth cylindrical sector 82 is received. As seen in FIG. 6, the width of the first longitudinal groove 90 is greater than the width of the second longitudinal groove 92. This difference between the width of the first longitudinal groove 90 and the width of the second longitudinal groove 92 provides a keying function to ensure proper orientation of the female shield terminal 24 within the cavity 36 of the inner connector housing 34.

The first transition section 76 is in contact with an inner wall of the cavity 36 within the first longitudinal groove 90, thereby defining a first longitudinal contact zone 94. The second transition section 78 also is in contact with the inner wall of the cavity 36 within the first longitudinal groove 90 opposite the first longitudinal contact zone 94, thereby defining a second longitudinal contact zone 96 with the inner wall of the cavity 36 within the first longitudinal groove 90. There is a gap 98 between the remainder of the connection portion 38 and the inner wall of the cavity 36. As used herein, the remainder of the connection portion 38 includes the first, second, third, fourth, and fifth cylindrical sectors as well as the third and fourth transition sections.

As the male shield terminal 48 is inserted within the female shield terminal 24, the male shield terminal 48 contacts the first and second cylindrical sectors 62, 64, thereby causing the first and second cylindrical sectors 62, 64 to increase the effective diameter between them by pushing outwardly into the gap 98 between the connection portion 38 and the inner connector housing 34. As used herein, the effective diameter is a measure of the distance between the first and second cylindrical sectors 62, 64 taken through the geometric center point of the first and second cylindrical sectors 62, 64.

Without subscribing to any particular theory of operation, the increase of the effective diameter is afforded by the flexing of the fifth cylindrical sector 82 and the narrowing of the longitudinal slot 80 between the third and fourth cylindrical sectors 70, 74 as the first and second transition sections 76, 78 pivot about the first and second longitudinal contact zones 94, 96 respectively. Flexing of the fifth cylindrical sector 82 maintains a compressive force between the first and second cylindrical sectors 62, 64 and the male shield terminal 48. Because the first and second cylindrical sectors 62, 64 have a sector angle 68 of 54 to 108 degrees or more, 30 to 60 percent or more of the first and second cylindrical sectors 62, 64 are in intimate contact with the male shield terminal 48. In the illustrated example, the effective diameter after insertion of the male shield terminal 48 within the female shield terminal 24 is substantially equal to two times the first radius 66.

As shown in FIG. 4, leading edges of the first and second cylindrical sectors 62, 64 are chamfered to facilitate spreading the first and second cylindrical sectors 62, 64 apart as the leading edge of the male shield terminal 48 is inserted into the female shield terminal 24.

Although the example of the assembly 10 presented herein has a right angle, i.e. 90 degree, connection orientation between the first and second coaxial cables 14, 18, other embodiments of the assembly may be envisioned with different connection orientation between the first and second coaxial cables 14, 18, particularly a straight, i.e. 180 degree, connection orientation.

Additionally, while the example assembly 10 shown here has the female shield terminal 24 surrounding the female socket terminal 20 and the male shield terminal 48 surrounding the male pin terminal 44, alternative embodiments of the assembly may have a female shield terminal surrounding a male pin terminal and a male shield terminal surrounding a female socket terminal.

Accordingly, an electrical connector assembly 10 is presented. The assembly 10 provides a lower cost stamped and formed female shield terminal 24 that offers improved shielding effectiveness due to the large contact surface between the female shield terminal 24 and male shield terminal 48. This large contact surface is provided by the first and second cylindrical sectors 62, 64 being in radially intimate contact with the male shield terminal 48. The open longitudinal slot 80 between the third and fourth cylindrical sectors 70, 74 also simplifies the design and manufacturing of the female shield terminal 24 by eliminating the need to create a tight seam in the connection portion 38 and eliminates a welding process or dovetail features formed in the female shield terminal 24 that would be required to maintain the tight seam.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. An electrical connector assembly, comprising:

a dielectric connector housing having a cavity defining a cavity wall extending longitudinally therethrough; and a shield terminal disposed within the cavity, the shield terminal having an attachment portion configured to receive a shield conductor of a coaxial cable and a connection portion configured to receive a cylindrical mating shield terminal, wherein the connection portion and the cavity wall cooperate to apply a compressive force on the mating shield terminal when the mating shield terminal is inserted within the connection portion.

2. The electrical connector assembly according to claim 1, wherein at least 30 percent of a connection portion inner wall is in intimate contact with a mating shield terminal outer wall when the mating shield terminal is inserted within the connection portion.

3. The electrical connector assembly according to claim 2, wherein at least 60 percent of the connection portion inner wall is in intimate contact with the mating shield terminal outer wall when the mating shield terminal is inserted within the connection portion.

4. The electrical connector assembly according to claim 1, wherein the shield terminal is configured such that an effective diameter of the at least 30 percent of the connection portion inner wall increases when the mating shield terminal is inserted within the connection portion.

5. The electrical connector assembly according to claim 1, wherein intersections between the connection portion and a cavity inner wall define two separate longitudinal contact zones and wherein the cavity defines a gap between a remainder of the connection portion and the cavity inner wall.

6. An electrical connector assembly, comprising:

a dielectric connector housing having a cavity extending longitudinally therethrough; and a shield terminal disposed within the cavity, the shield terminal having an attachment portion configured to receive a shield conductor of a coaxial cable and a connection portion configured to receive a cylindrical mating shield terminal, wherein the connection portion defines a first cylindrical sector and a second cylindrical sector arranged opposite one another each having a first radius and wherein the first and second cylindrical sectors are in intimate contact with a mating shield terminal outer wall when the mating shield terminal is inserted within the connection portion and wherein the connection portion defines a third cylindrical sector having a second radius greater than the first radius and a first transition section between the first cylindrical sector and the third cylindrical sector.

7. The electrical connector assembly according to claim 6, wherein the first and second cylindrical sectors each defining an angle of at least 54 degrees.

8. The electrical connector assembly according to claim 7, wherein the angle defined by the first cylindrical sector and the second cylindrical sector is at least 108 degrees.

9. The electrical connector assembly according to claim 6, wherein the first radius is substantially equal to a mating shield terminal radius.

10. The electrical connector assembly according to claim 6, wherein the connection portion defines a fourth cylindrical sector having the second radius and a second transition section between the second cylindrical sector and the fourth cylindrical sector.

11. The electrical connector assembly according to claim 6, wherein the first transition section is in contact with a cavity inner wall, thereby defining a longitudinal contact zone and wherein the second transition section also is in contact with the cavity inner wall, thereby defining another longitudinal contact zone with the cavity inner wall.

12. The electrical connector assembly according to claim 11, wherein the cavity defines a gap between a remainder of the connection portion and the cavity inner wall.

13. The electrical connector assembly according to claim 11, wherein the connection portion defines a longitudinal slot intermediate the third cylindrical sector and the fourth cylindrical sector.

14. The electrical connector assembly according to claim 13, wherein the connection portion defines a fifth cylindrical sector having a third radius greater than the first radius, wherein the fifth cylindrical sector is disposed intermediate the first cylindrical sector and the second cylindrical sector, and wherein a third transition section is defined between the first cylindrical sector and the fifth cylindrical sector and a fourth transition section is defined between the second cylindrical sector and the fifth cylindrical sector.

15. The electrical connector assembly according to claim 14, wherein the cavity defines a first longitudinal groove in which the third and fourth cylindrical sectors are received and wherein the cavity defines a second longitudinal groove in which the fifth cylindrical sector is received.

16. The electrical connector assembly according to claim 15, wherein a first longitudinal groove width is greater than a second longitudinal groove width.

17. The electrical connector assembly according to claim 6, wherein leading edges of the first and second cylindrical sectors are chamfered.

18. An electrical connector assembly, comprising:

a dielectric connector housing having a cavity extending longitudinally therethrough; and a shield terminal disposed within the cavity, the shield terminal having an attachment portion configured to receive a shield conductor of a coaxial cable and a connection portion configured to receive a cylindrical mating shield terminal, wherein the connection portion and the cavity cooperate to apply a compressive force on the mating shield terminal when the mating shield terminal is inserted within the connection portion, the shield terminal having means for putting at least 30 percent of the connection portion inner wall in intimate contact with the mating shield terminal outer wall when the mating shield terminal is inserted within the connection portion.

* * * * *